United States Patent [19]

Beck

[11] Patent Number: 4,482,083

[45] Date of Patent: Nov. 13, 1984

[54] COFFEE SAVER

[75] Inventor: Michel D. Beck, Norcross, Ga.

[73] Assignee: Bernice M. Beck, Glendale, Calif.

[21] Appl. No.: 431,728

[22] Filed: Sep. 30, 1982

[51] Int. Cl.[3] ..... B65D 25/40

[52] U.S. Cl. ..... 222/500; 222/461; 222/482; 222/547; 141/98; 99/279; 137/38

[58] Field of Search ..... 222/500, 564, 566, 567, 222/547, 481, 482, 491, 495, 520, 521, 478, 460, 484, 461, 522, 525; 99/284, 289 R, 290, 275, 279, 295, 300; 141/98, 312, 331; 137/38

[56] References Cited

U.S. PATENT DOCUMENTS

| | | | |
|---|---|---|---|
| 1,014,294 | 1/1912 | Garvey . | |
| 1,714,482 | 1/1923 | Schmuziger . | |
| 2,572,101 | 1/1948 | Bloch . | |
| 3,974,758 | 8/1976 | Stone, Jr. | 99/275 |
| 3,987,941 | 10/1976 | Blessing | 222/386 |
| 4,261,484 | 4/1981 | DaCosta et al. | 222/500 |
| 4,261,487 | 4/1981 | Seager | 222/520 |
| 4,361,257 | 11/1982 | Stone, Jr. | 222/464 |

OTHER PUBLICATIONS

Brochure-Ever Fresh Coffee Decanter, Wood Manufacturing Co., Inc. Box 646-Highway 178 North, Flippin, Ark. 72634.

*Primary Examiner*—Joseph J. Rolla
*Assistant Examiner*—George S. Pyryt
*Attorney, Agent, or Firm*—Jones & Askew

[57] ABSTRACT

A device for use with a container for liquid, such as a coffee pot, having a neck which defines an opening. The device comprises a sleeve adapted to fit in sealing relationship with the neck. A funnel member is disposed within the sleeve and is movable within the sleeve between a first position and a second position. The funnel member is in the first position when the container is in an upright position whereby liquid can be introduced into the container through the funnel member and the escape of vapors from liquid contained in the container through the sleeve is substantially restricted. The funnel member is in the second position when the container is tipped to pour liquid therefrom whereby liquid in the container can flow past the funnel member between the sleeve and the funnel member.

11 Claims, 6 Drawing Figures

COFFEE SAVER

FIELD

The present invention relates to containers for liquids, and, particularly to a device which fits in the neck of a container to affect the flow of liquids and vapors into and out of the container.

BACKGROUND

It has been recognized that the flavor and aroma of coffee deteriorates or is adversely effected by oxidation. Oxidation can result from excessive exposure of the coffee to the atmosphere. It is also believed that the loss of vapors or steam from the liquid results in reduced flavor and aroma. This is particularly true in situations where a pot of coffee stands in a heated condition for a long period of time after brewing so that rather significant amounts of vapors or steam can escape from the pot.

This problem of coffee deterioration has been previously recognized in U.S. Pat. No. 3,974,758 to Stone (incorporated herein by reference). In that patent, a follower member is used to reduce the surface area of the coffee which is exposed to the atmosphere. It is also known in other patents to use various devices to inhibit the loss of vapors from a liquid or to limit the area of contact between a liquid and its surrounding atmosphere. See for example, U.S. Pat. Nos. 1,014,294; 1,714,482; 2,572,101 and 3,987,941 (all incorporated herein by reference).

Accordingly, heretofore a device which is effective for preserving the aroma and taste of coffee has not been known.

BRIEF SUMMARY OF THE INVENTION

The present invention relates to a device for use with a container for liquid, such as a coffee pot, having a neck which defines an opening. The device comprises a sleeve adapted to fit in sealing relationship with the neck. A funnel member is disposed within the sleeve and is movable within the sleeve between a first position and a second position. The funnel member is in the first position when the container is in an upright position whereby liquid can be introduced into the container through the funnel member and the escape of vapor or steam for liquid contained in the container is substantially restricted. The funnel member is in the second position when the container is tipped to pour liquid therefrom whereby liquid in the container can flow past the funnel member between the sleeve and the funnel member.

Accordingly, it is an object of the present invention to provide an improved container for a liquid, such as coffee.

Another object of the present invention is to provide a device which reduces the amount of oxidation and evaporation of coffee that occurs in conventional coffee containers.

A further object of the present invention is to provide a device which preserves the aroma and taste of coffee upon standing for a relatively long period of time.

Yet another object of the present invention is to provide a device to preserve coffee flavor and aroma which device can be used in association with conventional type coffee containers.

Another object of the present invention is to provide a device to preserve coffee flavor and aroma which device can be removed from its associated coffee container for relatively easy cleaning of the device and the coffee container.

Still another object of the present invention is to provide a device to preserve coffee flavor and aroma which device permits the addition of coffee to the associated coffee container and the pouring of coffee from the coffee container without the necessity of removing the device from the coffee container.

These and other objects, features and advantages of the present invention will become apparent after a review of the following detailed description of the disclosed embodiments and the appended drawing and claims.

DETAILED DESCRIPTION OF THE DISCLOSED EMBODIMENTS

Figure 1:
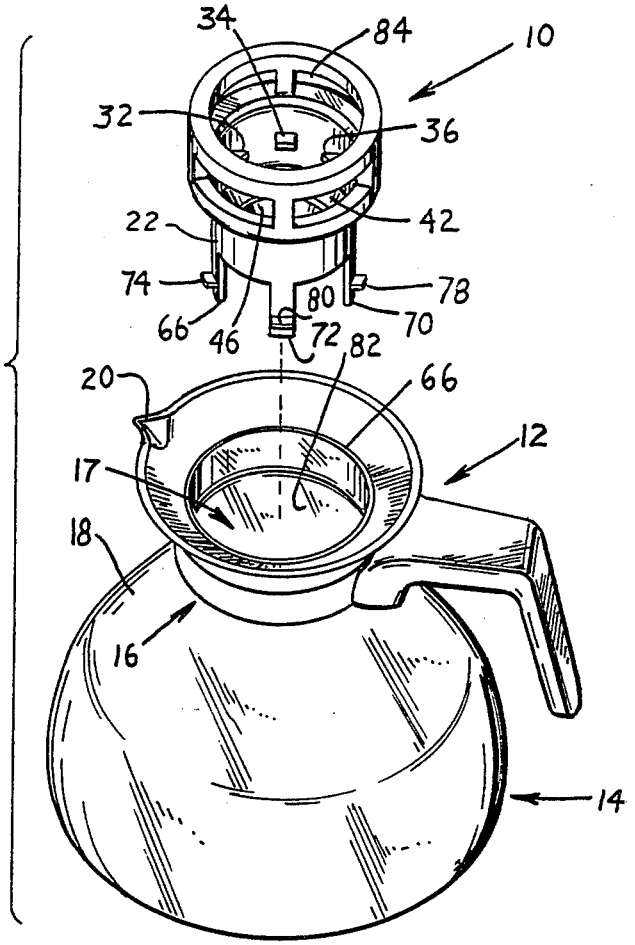
FIG. 1 is an exploded pictorial view of a disclosed embodiment of the coffee saver device of the present invention shown in use with a conventional coffee pot.

Referring now to the drawing in which like numbers indicate like elements throughout the several views, it will be seen that there is a coffee saver device 10 in accordance with the present invention in a conventional coffee container 12. It will be appreciated by those skilled in the art that coffee containers are available in a wide range of sizes and shapes, such as pots, decanters, urns and the like. It is specifically contemplated that the present invention can be used with coffee containers of virtually any size or shape. The only requirement of the coffee container is that it define an opening at its top through which liquid is introduced into the container and liquid is poured from the container. Accordingly, the coffee container 12 includes a body portion 14 and a neck portion 16 formed from a continuous piece of glass 18, although other suitable materials can also be used. The glass 18 at the neck portion 16 of the container defines an opening 17 through which liquid can be introduced into the container and liquid can be poured from the container and into which the coffee saver device 10 is fitted. The coffee container 12 also includes a pouring spout 20 which is attached to the neck portion 16 of the container and which can be formed integrally with the glass 18 or can be a separate piece as shown. Although it is conventional and desirable for coffee containers to include a pouring spout, it is not necessary to the present invention.

Figure 3:
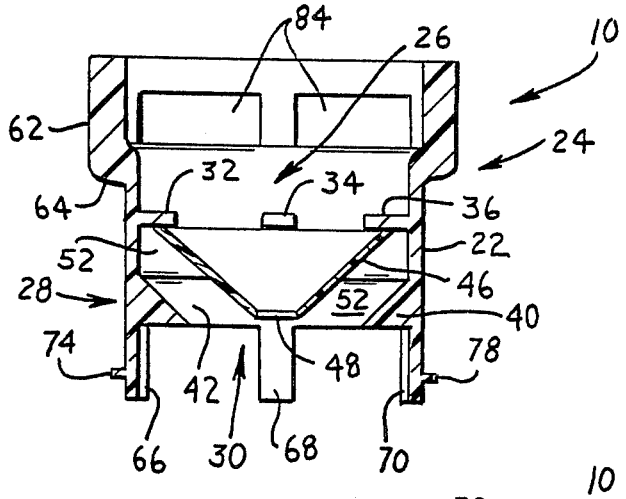
FIG. 3 is a cross-sectional view of the coffee saver device shown in FIG. 1 shown with the funnel member in an up position.
Figure 4:
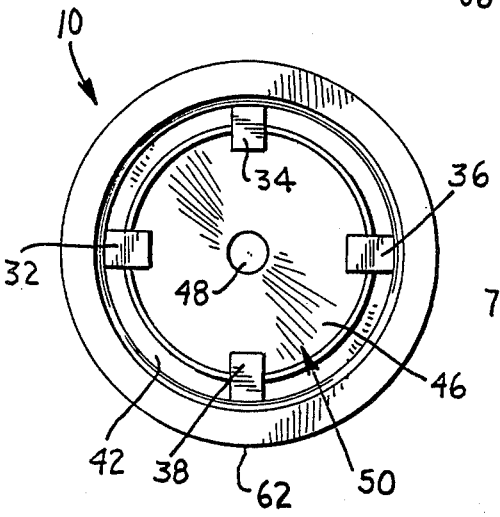
FIG. 4 is a top view of the coffee saver device shown in FIG. 1.

The coffee saver device 10 comprises a hollow sleeve 22 having an upper end 24 defining an upper opening 26 and a lower end 28 defining a lower opening 30 (FIG. 3). Adjacent the upper opening 26 and extending radially inwardly from the sleeve 22 are four upper flanges 32, 34, 36, 38. Adjacent the lower opening and extending radially inwardly from the sleeve 22 is a lower annular flange 40. The annular flange 40 includes an upper beveled or sloping surface 42.

Figure 2:
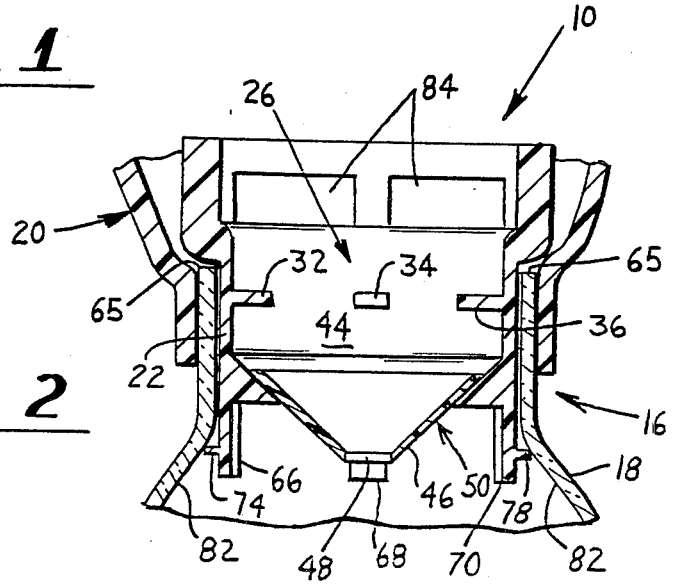
FIG. 2 is a partial cross-sectional view of the coffee saver device and pot shown in FIG. 1 shown with the funnel member in a down position.

The sleeve 22 defines a chamber 44 between the upper flanges 32–38 and the lower annular flange 40. Disposed within the chamber 44 is a funnel-shaped member 46 which is movable within the chamber from a first or down position, as shown in FIG. 2, to a second or up position, as shown in FIG. 3. Movement of the funnel member 46 is affected by gravity and by liquid flowing into and out of the coffee container 12. The funnel member 46 defines an opening 48 at the lower portion thereof. The size of the opening 48 in the funnel member 46 is substantially smaller than the opening 17 at the neck portion 16 of the coffee container 12. The size of the opening 48 in the funnel member 46 should be as small as possible without severely restricting the ability of liquid to flow through the funnel member into the coffee container 12.

The funnel member 46 also includes sloping surfaces 50 which have an angle of slope substantially the same as the angle of slope of the surface 42 of the lower annular flange 40. It will therefore be appreciated that when the funnel member 46 is in the down position (FIG. 2), the funnel member engages the lower annular flange 40 in a substantially liquid sealing relationship so that liquid entering the coffee container 12 flows exclusively through the opening 48 of the funnel member and vapors or steam evolving from liquid in the coffee container is substantially prevented from passing between the funnel member and the lower annular flange.

Figure 5:
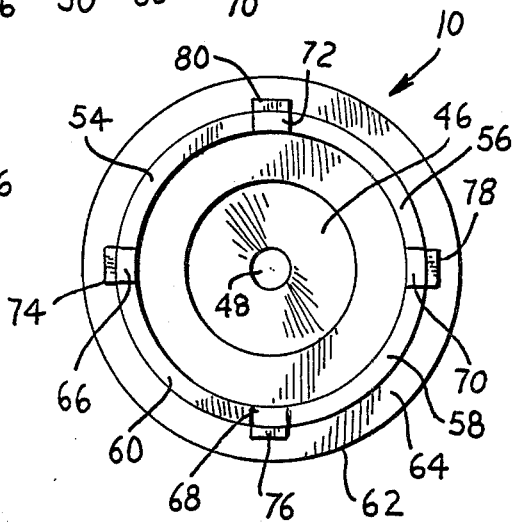
FIG. 5 is a bottom view of the coffee saver device shown in FIG. 1.

When the funnel member 46 is in the upper position (FIG. 3), it engages the upper flanges 32–38 which prevent the funnel member 46 from moving outside the chamber 44. Furthermore, when the funnel member 46 is in the upper position (FIG. 3), an annular space 52 is defined between the sloped surface 50 of the funnel member, the sloped surface 42 of the lower annular flange 40 and the sleeve 22. Additionally, since the outside diameter of the funnel member 46 at its widest point is less than the inside diameter of the sleeve 22, i.e. the diameter of the chamber 44, four openings 54, 56, 58, 60 (FIG. 5) are defined between the sleeve 22, the upper flanges 32–38 and the funnel member. It will be appreciated by those skilled in the art that with the funnel member 46 is in the upper position, liquid can flow through the sleeve 22 from the lower opening 30 to the upper opening 26 through the annular space 52 and the openings 54–60 substantially unrestricted.

The outside diameter of the sleeve 22 is approximately equal to inside diameter of the neck portion 16 of the coffee container 12 so that a substantially liquid proof seal is formed therebetween. In order to retain the sleeve 22 in the neck portion 16 of the coffee container, means are provided at the top and the bottom of the sleeve so that it will not fall into the body portion 14 of the container when it is in an upright position and so that it will not fall out of the neck portion when the container is tipped to pour liquid therefrom. Accordingly, attached to the upper end 24 of the sleeve 22 is an upper annular flange 62 which extends radially outwardly from the sleeve and also extends longitudinally upwardly from the upper end of the sleeve in coaxial alignment therewith. The upper annular flange 62 has an annular shoulder 64 adjacent the upper end 24 of the sleeve 22 which shoulder engages the upper end 65 of the glass 18 which forms the mouth of the coffee container 12. It will therefore be appreciated that the shoulder 64 provides a stop which prevents the sleeve 22 from moving downwardly through the neck portion 16 of the coffee container 12 past the shoulder.

Attached to the lower end 28 of the sleeve 22 and extending longitudinally downwardly from the sleeve are four legs 66, 68, 70, 72. Each of the legs 66–72 is provided with a flange 74, 76, 78, 80 which extends radially outwardly from its respective leg so that the effective outside diameter at the legs is greater than the outside diameter of the sleeve 22. The material from which the legs 66–72 are made should be sufficiently flexible so that the legs can be deflected slightly radially inwardly so that the lower portion of the coffee saver device 10 including the flanges 74–80 can be inserted and removed through the neck portion 16 of the coffee container 12. The positioning of the flanges 74–80 on the legs 66–72 is such that when the shoulder 64 engages the end 65 of the glass 18, the flanges engage the inner surface 82 of the glass at the curved portion immediately below the neck portion 16 of the coffee container 12. It will therefore be appreciated that the flanges 74–80 resist upward movement of the sleeve 22 and prevent the sleeve from falling out of the neck portion 16 when the coffee container 12 is tipped to pour liquid therefrom.

The upper annular flange 62 serves as a handle to facilitate insertion into and removal of the sleeve 22 from the neck portion 16 of the coffee container 12. The upper annular flange 62 also defines a plurality of openings 84 through which liquid can flow from the sleeve 22 to the spout 20 and should be designed so that the liquid the openings 84 in the annular flange 62 will depend upon the size and shape of the coffee container 12 and the size and shape of the pour spout 20 and should be designed so that the liquid will flow therethrough as smoothly as possible.

Figure 6:
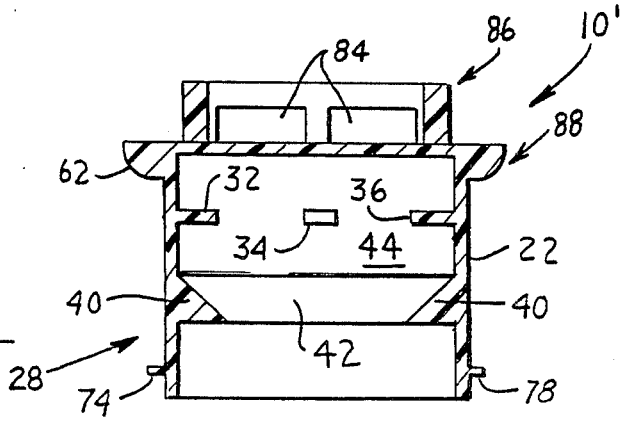
FIG. 6 is a cross-sectional view of an alternate disclosed embodiment of the coffee saver device of the present invention.

Referring now specifically to FIG. 6, there is disclosed an alternate disclosed embodiment for the coffee saver device 10′ which is suitable for use with relatively wide mouthed coffee containers. The coffee saver device 10′ eliminates the legs 66–72 and merely extends the length of the sleeve 22 beyond the lower annular flange 40. The flanges 74–80 are therefore attached directly to the lower portion of the sleeve 22. The upper annular flange 62 in the coffee saver device 10′ is also modified so that it comprises an upper portion 86 and a lower portion 88 of different outside diameters with the upper portion being of smaller outside diameter than the lower portion.

Use of the present invention will now be considered. The coffee saver device 10 is grasped by the upper annular flange 62 and inserted into the neck portion 16 of the coffee container 12 by exerting downward pressure on the device until the shoulder 64 engages the end 65 of the glass 18. The coffee container 12 is then placed under a conventional drip-type coffee brewing apparatus (not shown). In a manner well known in the art, brewed coffee emerges from the brewing apparatus in a downwardly directed stream. The coffee container 12 is positioned under the stream of coffee so that the opening 48 in the funnel member 46 is in alignment with the stream of coffee. The funnel member 46 permits slight errors in alignment of the coffee container 12 and the stream of coffee and directs the coffee through the opening 48. The stream of coffee therefore enters the body member 14 of the coffee container 12 by passing through the sleeve 22 and the funnel member 46 substantially uninhibited.

When the coffee container 12 is in its upright position, the funnel member 46 is in the down position (FIG. 2) due to the effects of gravity on the funnel member. It is in this position that the coffee container may remain for extended periods of time prior to or between periods of dispensing coffee from the container. During this time, the residual heat from brewing causes the coffee in the body portion 14 of the container 12 to evolve vapors or steam. Furthermore, it is typical to provide an auxilliary heating element (not shown) below a coffee container or built into the bottom of a coffee container. An auxilliary heating element can maintain the temperature of the coffee in the container at an elevated temperature for a prolonged period of time thereby maintaining a relatively high rate of vapor or steam production from the coffee in the body portion 14 of the container 12. It is the loss and oxidation of that vapor or steam which the present invention is intended to reduce.

The heated vapors or steam evolving from the coffee in the body portion 14 of the container 12 generally tend to rise. Without the coffee saver device 10 in the neck portion 14 of the container 12, that vapor or steam would be free to escape through the neck of the container, thereby causing a degradation in the taste and aroma of the coffee. However, with the coffee saver device 10 in the neck portion 14 of the container 12, escape of the vapors or steam from the container is severely restricted. Since there is a seal between the glass 18 at the neck portion 14 of the container 12 and the sleeve 22 and since there is a seal between the funnel member 46 and the lower annular flange 40, the only place for the vapor or stream to escape is through the opening 48 in the funnel member. However, since that opening 48 is substantially smaller than the opening defined by the neck portion 14 of the container 12, the opportunity for the vapor or steam to escape is substantially reduced. Furthermore, the sloped surfaces 50 of the funnel member 46 provide a surface on which the rising vapor or steam can condense and fall back into the liquid in the body portion 14 of the container. It will therefore be appreciated that the loss of vapors or steam from the coffee in the container 12 is substantially reduced.

When it is desired to dispense coffee due to the effect of gravity thereon. When the that the opening defined by the neck portion is lower than the level of the coffee in the container whereby the coffee will flow out of the container due to the effect of gravity thereon. When the container 12 is tipped as described above, gravity also effects the funnel member 46 which is free to move within the chamber 44 and causes the funnel member to move from its down position (FIG. 2) to its up position (FIG. 3). Movement of liquid through the sleeve 22 from the opening 30 toward the opening 26 can also move the funnel member 46 from the down position to the up position. When the funnel member 46 is in its up position due to the tipping of the container 12, the coffee can flow through the sleeve 22 by flowing through the space 52, through the openings 54–60 and through the openings 84 to the pour spout 20. It will therefore be appreciated that liquid in the container 12 can be poured therefrom substantially uninhibited without removing the coffee saver device 10 from the neck portion 14 of the container.

When it is desired to clean the coffee container 12, the coffee saver device 10 can be removed from the neck portion 14 of the container 12 by grasping the upper annular flange 62 and pulling away from the container.

Although the present invention has been described as being useful for preserving the taste and aroma of coffee, it is specifically contemplated that the present invention can be used to preserve other liquids that tend to lose or evolve vapors or steam, such as tea, hot chocolate or milk and the like.

While this invention has been described in detail with particular reference to preferred embodiments thereof, it will be understood that variations and modifications can be effected within the spirit and scope of the invention as described hereinbefore and as defined in the appended claims.

I claim:

1. A device for use with a container for liquid, said container having a neck which defines an opening, said device comprising:

a sleeve adapted to fit in sealing relationship with said opening, a member disposed in said sleeve and movable within said sleeve between a first position and a second position, said member having an opening;

said member being in said first position when said container is in an upright position, whereby liquid can be added to said container through said opening in said member and the escape of vapors from liquid contained in said container through said sleeve is substantially restricted by said member; and said member being in said second position when said container is tipped to pour liquid therefrom, whereby liquid in said container can flow past said member between said sleeve and said member.

2. A device for use with a container for liquid, said container having a neck which defines an opening, said device comprising:

a sleeve adapted to fit in sealing relationship with said neck, said sleeve having an upper end, a lower end and an inside diameter;

a lower annular flange within said sleeve adjacent said lower end and extending radially inwardly from said sleeve;

at least one upper flange within said sleeve adjacent said upper end longitudinally spaced from said lower flange and extending radially inwardly from said sleeve;

a funnel member disposed within said sleeve between said upper flange and said lower flange and movable therebetween, said funnel member being sealable with said lower flange such that liquid cannot pass beween said funnel member and said sleeve and said funnel member being engageable with said upper flange such that liquid can pass between said funnel member and said sleeve;

an exterior annular flange adjacent said upper end of said sleeve and extending radially outwardly from said sleeve, said flange having a shoulder which is engagable with an upper portion of said neck of said container for partially retaining said sleeve in said neck;

at least one flange adjacent said lower end of said sleeve and extending radially outwardly from said sleeve, said flange being engagable with a lower portion of said neck of said container for partially retaining said sleeve in said neck;

said exterior annular flange defining at least one opening through which liquid can flow from said upper end of said sleeve, said flange being sized and shaped to provide a handle for manually inserting said sleeve into and removing said sleeve from said neck;

said funnel member being sealed with said lower flange when said container is in an upright position whereby liquid can be introduced into said container through said funnel member; and said funnel member being engaged with said upper flange when said container is tipped to pour liquid therefrom whereby liquid in said container can flow past said funnel member between said sleeve and said funnel member.

3. A device for use with a container for liquid, said container having a neck which defines an opening, said device comprising:

a sleeve adapted to fit in sealing relationship with said neck;

a funnel member disposed within said sleeve and movable within said sleeve between a first position to a second position;

said funnel member being in said first position when said container is in an upright position whereby liquid can be introduced into said container through said funnel member; and said funnel member being in said second position when said container is tipped to pour liquid therefrom whereby liquid in said container can flow past said funnel member between said sleeve and said funnel member.

4. The device of claim 3 wherein said sleeve has an inner diameter and said funnel member has an outside diameter which is less than said inner diameter of said sleeve.

5. The device of claim 3 wherein said funnel member has an opening which is substantially smaller in area than said opening defined by said neck of said container.

6. The device of claim 3 wherein said funnel member is shaped to provide a sloped surface adjacent said liquid in said container whereby vapors escaping from said liquid can condense on said sloped surface.

7. The device of claim 3 further comprising means for retaining said sleeve in said neck.

8. The device of claim 3 further comprising an annular flange extending radially inwardly within said sleeve and being in sealing engagement with said funnel member when said funnel member is in said first postion.

9. The device of claim 8 further comprising a flange extending radially inwardly within said sleeve and being in non-sealing engagement with said funnel member when said funnel member is in said second position.

10. The device of claim 3 further comprising handle means attached to said sleeve for removing said sleeve from said neck.

11. The device of claim 10 wherein said handle means defines at least one opening through which liquid can flow.

* * * * *